US006966970B2

(12) United States Patent
Snekkenes et al.

(10) Patent No.: US 6,966,970 B2
(45) Date of Patent: Nov. 22, 2005

(54) METHOD FOR SUPPLYING WASHING LIQUID TO A PROCESS FOR COOKING CELLULOSE PULP

(75) Inventors: Vidar Snekkenes, Karlstad (SE); Lennart Gustavsson, Karlstad (SE)

(73) Assignee: Kvaerner Pulping AB, (SE)

( * ) Notice: Subject to any disclaimer, the term of this patent is extended or adjusted under 35 U.S.C. 154(b) by 250 days.

(21) Appl. No.: 10/474,223

(22) PCT Filed: Apr. 29, 2002

(86) PCT No.: PCT/SE02/00832

§ 371 (c)(1),
(2), (4) Date: Oct. 8, 2003

(87) PCT Pub. No.: WO02/088461

PCT Pub. Date: Nov. 7, 2002

(65) Prior Publication Data

US 2004/0108084 A1 Jun. 10, 2004

(30) Foreign Application Priority Data

May 2, 2001 (SE) ..... 0101557

(51) Int. Cl.[7] ..... D21C 9/04; D21C 3/26

(52) U.S. Cl. ..... 162/60; 162/17; 162/19; 162/237; 162/242

(58) Field of Search ..... 8/156; 162/17, 162/19, 52, 60, 237, 246, 248, 250

(56) References Cited

U.S. PATENT DOCUMENTS 1,934,957 A * 11/1933 Wells ..... 162/14
3,700,548 A * 10/1972 Rich et al. ..... 162/17
4,028,171 A * 6/1977 Richter ..... 162/19
4,123,318 A * 10/1978 Sherman ..... 162/19
4,436,586 A * 3/1984 Elmore ..... 162/19
5,066,362 A * 11/1991 Meredith ..... 162/17
5,203,963 A * 4/1993 Henricson ..... 162/19
5,681,427 A * 10/1997 Lora et al. ..... 162/232
5,919,337 A * 7/1999 Olsson et al. ..... 162/17
6,179,958 B1 * 1/2001 Lysen et al. ..... 162/17
6,379,504 B1 * 4/2002 Miele et al. ..... 162/237
6,605,180 B2 * 8/2003 Snekkenes et al. ..... 162/17
6,699,357 B2 * 3/2004 Snekkenes et al. ..... 162/17

FOREIGN PATENT DOCUMENTS

EP 476230 B1 * 12/1996 ..... D21C 3/02

* cited by examiner

*Primary Examiner*—Steven P. Griffin

*Assistant Examiner*—Anna L. Kinney

(74) *Attorney, Agent, or Firm*—Rolf Fasth; Fasth Law Offices

(57) ABSTRACT

The invention relates to a method for supplying washing liquid to a digester (1) for cellulose pulp and a subsequent diffuser washing device (2a, 2b). A high, disturbance-free production capacity can be obtained by using a common feed pump (P1) which, via a main feed line (10), supplies both the diffuser washing device and the digester with washing liquid in parallel. The first pump (P1) establishes a pressure on the washing liquid which is in the interval 2–6 bar, and is preferably 4 bar, while the second pressure level, which is established by the diffuser pump device (P2*a*, P2*b*), is in the interval 6–12 bar, but is at least 2 bar higher than the first pressure level, and the third pressure level, which is established by the digester pump (P3), is in the interval 12–25 bar The system becomes self-regulating in the event of any operational disturbances in the flow of washing liquid and, if the pumps are appropriate, a countercurrent flow of washing liquid through the system is essentially maintained.

8 Claims, 1 Drawing Sheet

METHOD FOR SUPPLYING WASHING LIQUID TO A PROCESS FOR COOKING CELLULOSE PULP

PRIOR APPLICATION

Figure 1:
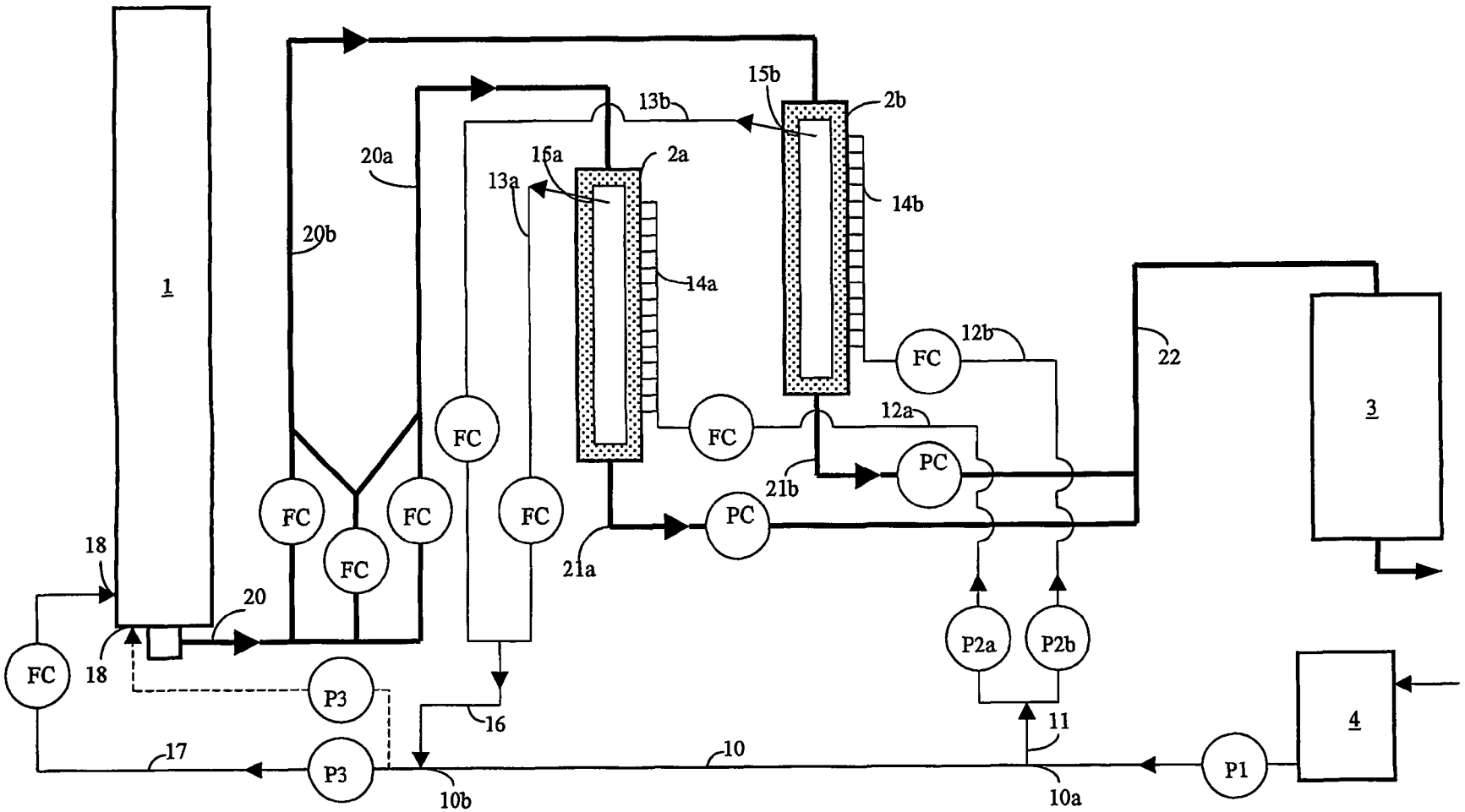

This application is a U.S. national phase application based on International Application No. PCT/SE02/00832, filed 29 Apr. 2002, claiming priority from Swedish Patent Application No. 0101557-7, filed 2 May 2001.

The present invention relates to a method for supplying washing liquid to a digester for cellulose pulp and a subsequent diffuser washer.

STATE OF THE ART

The combination of a continuous digester and a subsequent diffuser is frequently employed when manufacturing chemical cellulose pulp, especially kraft pulp. As is customary, washing liquids for the different constituent processes are conducted in countercurrent to the flow of the pulp, with the washing liquid first being fed to the diffuser, after which the wash filtrate which is obtained from the diffuser is conducted to the washing zone of the digester as dilution liquid and/or washing liquid. This countercurrent flow of washing liquids is implemented for the purpose of reducing, to the greatest possible extent, the consumption of fresh water, something which has been regarded as being an absolute necessity for being able to close the process and minimize the discharge of process water from the process.

U.S. Pat. No. 4,123,318 discloses such a countercurrent conveyance of washing liquid, with filtrate from a washing stage subsequent to the digester being conducted to the preceding washing stage in the process and from the washing stage to the washing zone of the preceding digester.

U.S. Pat. No. 5,066,362 also discloses a system in which the washing liquid is firstly conducted to a diffuser after which the wash filtrate which is obtained from the diffuser is conducted to the washing zone of the digester. This provides a gradual leaching-out/washing of the pulp and a gradually increasing content of released material in the wash filtrate which is being conducted in countercurrent to the flow of the pulp. The washing liquid is also conducted strictly in countercurrent to the flow of the pulp in SE,C, 501848, with the washing liquid firstly being conducted to a diffuser, after which the diffuser filtrate is conducted to the washing zone of the digester. All that otherwise takes place is that a supplement of white liquor is conveyed to the diffuser filtrate for the purpose of increasing the level of alkali in the diffuser filtrate.

In order to increase the operability in these systems, buffer tanks or intermediate storage tanks are used for the diffuser filtrate so as to ensure that washing liquid can be supplied to the digester at a constant rate. These tanks frequently have to be designed as expensive pressure vessels since the temperature of the washing liquids at these positions is close to, or above, the boiling point of the washing liquid.

The known systems function satisfactorily when production is moderate and if there are no disturbances in the process. However, if the diffuser, whose washing efficiency is normally very good, should exhibit a tendency to cause clogging in the flow of washing liquids, due, for example, to inappropriate handling, this then affects the digester directly as a result of a corresponding decline in washing liquid and dilution liquid being supplied to the bottom of the digester. While this greatly reduces the washing effect at the bottom of the digester, another marked effect is that it can become difficult to achieve the dilution in pulp concentration which is required in association with the pulp being blown from the digester, something which immediately involves the risk of giving rise to clogging in the flow of pulp from the digester and of the temperature of the pulp rising rapidly to an undesirable level. In order to deal with this clogging, it may be necessary for the digester to be shut down completely.

OBJECT AND PURPOSE OF THE INVENTION

The principal object of the invention is to avoid the disadvantages of the prior art and to enable the operability of the cooking process to be improved in the digester/diffuser constituent system, with it being possible to increase the productivity in an existing digester (more pulp per 24 hours) by more than 100%. By means of totally integrating the digester and the diffuser, most of the extraction from the cooking can instead be transferred to the diffuser and the loading on the digester's extraction screens can consequently be reduced, thereby making it possible to achieve this substantial upgrading of the digester capacity. This becomes particularly advantageous when upgrading existing digesters. As a result of a large part of the extraction from the cooking being made in the pressure diffuser, the pressure and/or liquor level in the digester can be controlled by means of this extraction from the diffuser.

Another object is to make the process less sensitive to disturbances in the flow of washing liquid through the diffusers, with it being possible to maintain the digester process under optimum conditions despite the occurrence of momentary disturbances in the flow of washing liquid through a diffuser.

Yet another object is to optimize the procedure with regard to supplying washing liquid such that only that pressure level which is required is maintained at each point in the supply system, thereby making it possible to set the greater part of the system at a moderately low level, thus enabling thinner pipelines to be used.

Yet another object is to obtain a system for providing the diffuser and digester with washing liquid, which system is self-regulating and can at any moment guarantee the requisite flow of washing liquid to the washing and dilution zone of the digester. Pulp can then be guaranteed to be fed out from the digester at the correct consistency and temperature, thereby actively counteracting any tendency towards clogging in the pulp flow leaving the digester, on the one hand, and, on the other hand, eliminating any lowering in the quality of the pulp due to the blowing temperature being too high. As a result of this self-regulation, the major part of the flow of washing liquid to the bottom of the digester will pass via the diffusers during normal operation. However, as soon as any local blockage of washing liquid occurs in a diffuser, a self-regulation then takes place, with this self-regulation compensating for the decline in filtrate flow from the diffuser with an equivalent flow from the diffuser's washing liquid tank.

Yet another object is to be able to remove all the buffer or intermediate storage tanks for the diffuser filtrate, thereby substantially reducing the investment costs.

LIST OF DRAWINGS

FIG. 1 shows a diagram of a system according to the invention, with a digester and two subsequent diffusers which are coupled in parallel:

DETAILED DESCRIPTION OF PREFERRED EMBODIMENTS

FIG. 1 shows a system according to the invention for supplying washing liquid to a continuous digester 1 for cellulose pulp and a subsequent diffuser washing device 2*a*, 2*b* in which washing liquid 12*a*, 12*b* for the diffuser washing device is drawn from a storage tank 4 and in which washing liquid 17 is conducted to the bottom of the digester in order to obtain a dilution and/or a displacement washing at the bottom of the digester.

The cellulose pulp which is dissolved in the digester is fed out in the flow 20 and a Y-coupling arrangement is preferably used to ensure the establishment of two constituent flows 20*a*, 20*b* to two diffusers, which consequently operate in parallel. The central branch in the Y coupling provides an alternative auxiliary feeding route for the flow 20*a* or else the flow 2O*b*. After the diffusers, washed pulp 21*a*, 21*b* is withdrawn from each respective diffuser and combined in the flow 22 for subsequent conduction to a storage tank 3 for the cooked and washed pulp.

The diffuser is a conventional pressure diffuser which maintains the pressure in the pulp during the washing. The diffuser can be either fed from the bottom or the top, and the figure shows a top-fed pressure diffuser. The pulp is conducted into the top of the pressure diffuser, after which it passes down through the pressure diffuser in a thin circular layer, with the washing liquid being fed in from outside the layer (marked grey in the figure) by way of a multiplicity of distribution nozzles 14*a*, 14*b*, which are arranged, on the one hand, around the whole of the pressure diffuser (not shown) and, on the other hand, over the greater part of the height of the pressure diffuser (as shown in the figure). The washing filtrate which is obtained after the washing liquid has passed through the fibre layer is extracted from the inside of the pressure diffuser, 15*a*, 15*b*, with these filtrate flows being indicated by 13*a* and 13*b* in the figure.

That which is characteristic of the invention is that the washing liquid from the storage tank 4 is pressurized to a first pressure level, by way of a first feeding pump P1, and is subsequently conducted to a main feed line 10. At a first upstream point 10*a* in the main feed line, a first constituent flow 11 is drawn from this main feed line 10 to a diffuser pump device P2*a*/P2*b* which pressurizes the washing liquid to a second pressure level and conducts it onward, 12*a*, 12*b*, at this second pressure level to the washing liquid inlets 14*a*, 14*b* belonging to a diffuser washer. The wash filtrate 13*a*, 13*b* from the washing liquid outlet 15*a*, 15*b* in the diffuser washer is conducted back to the main feed line 10 at a second point 10*b* in the main feed line, with this second point being located downstream of the first upstream point 10*a* in the main feed line. A combined flow of washing liquid from the storage tank 4 and wash filtrate 16 from the diffuser washing device 2*a*, 2*b* is conducted, via the main feed line, to a digester pump P3, which pressurizes the combined flow to a third pressure level, and is conducted onwards 17, at this third pressure level, to washing liquid nozzles 18 which are arranged at the bottom of the digester.

The pressure levels are related to each other such that the first pressure level is lower than the second pressure level, which second pressure level is in turn lower than the third pressure level, with each respective pressure level constituting an increase in pressure of at least 50–125% relative to the next lower pressure level.

In a preferred application, this corresponds to the first pressure level, which is established by the first feed pump P1, being in the interval 2–6 bar, preferably 4 bar, to the second pressure level, which is established by the diffuser pump device P2*a*, P2*b*, being in the interval 6–12 bar, but at least 2 bar above the first pressure level, and to the third pressure level, which is established by the digester pump P3, being in the interval 15–25 bar.

In a conventional pressure diffuser, the pump P2*a* should deliver a pressure which guarantees flow through the diffuser. The following falls in pressure occur in the diffuser circuit:

a) static height (difference in height between the pump and the upper part of the diffuser, approx. 2.5 bar);

b) pressure fall in lines and control valves (FC etc., approx. 1 bar);

c) the diffuser's inlet nozzles (14*a*, approx. 2 bar);

d) pressure fall through the pulp bed (approx. 0.5 bar);

e) prevailing pulp pressure at the top of the diffuser (depends on the digester pressure, its height + pressurization level, can typically be 6 bar).

With a feed pump P1 which delivers 4 bar, a guaranteed flow under normal operation is obtained if P2*a* provides an increase in pressure of a good 8 bar, on the assumption that the pulp pressure at the top of the diffuser is 6 bar. The governing prerequisite is that, under normal operation, the pressure on the flow 16 should at least be equal to the pressure of the feed pump.

The connection points 10*a* and 10*b* should expediently be located on the main feed line such that the point 10*b* lies at a distance from the digester pump P3 which is within 10% of the entire length of the feed line 10 and such that the point 10*a* lies at a distance from the outlet of the feed pump P1 which is within 10% of the entire length of the feed line 10. During normal, disturbance-free operation in the system, the fall in pressure in the feed line 10 between the points 10*a* and 10*b* should expediently exceed or correspond to the increased pressure in the washing liquid filtrate 13*a*, 13*b*.

In the embodiment shown, the diffuser washing device consists of two diffusers which are coupled in parallel as regards the receipt and treatment of cooked pulp obtained from the digester. This configuration provides increased availability in the system, with it being possible to redirect part of the pulp flow between diffusers depending on any possible momentary disturbances in the system.

The diffuser pump arrangement consists of two diffuser pumps P2*a* and P2*b*, which are coupled in parallel and which, on the inlet side, are connected to the same supply flow 11, which is taken from the main feed line 10, with each respective outlet from each of the diffuser pumps only supplying one diffuser with its respective washing liquid flow 12*a*, 12*b*. While P2*a* and P2*b* can, of course, be replaced with a single pump, two separate pumps provide increased availability. The wash filtrates 13*a* and 13*b*, which are obtained from each respective diffuser, are first of all combined to form a joint flow 16 in a Y coupling,. after which this combined wash filtrate flow 16 is returned to the main feed line at a point 10*b* on the main feed line closer to the inlet to the digester pump P3.

The whole of the system becomes self-adjusting with regard to any possible variations in the pulp flow and/or washing liquid flows, and no buffer tanks or intermediate storage tanks are required. When the pumps are adequate, the main flow of the washing liquid filtrate develops in the circuit 4-P1-11-P2*a*/P2*b*-2*a*/2*b*-16-P3-1; however, as soon as momentary restrictions in flow occur in the circuit due to pressure falls in the diffuser which are too great, the decline in the flow is then compensated by flow in the circuit P1-10*a*-10-10*b*-P3. In an application in which the capacity in an existing digester was increased from 1 500 AdT/24 hours to somewhat more than double the capacity, i.e. 3 200 Adt/24 hours, this then means that the rate of flow of the chips in the digester was more than doubled, representing a dramatic increase in production capacity. In connection with flow rates of this magnitude in the system, great demands are made on the retention of a high level of supply of washing liquid and dilution liquid to the bottom of the digester, thereby guaranteeing correct dilution and washing prior to the pulp being blown from the digester. The invention allows the existing production capacity to be increased dramatically while at the same time maintaining a high degree of operability and availability.

The invention can be varied in a number of ways within the scope of the attached patent claims.

For example, the parallel diffusers can be replaced by a single diffuser or, alternatively, supplemented with a third diffuser which is coupled in parallel.

The embodiment depicted in FIG. 1 shows flow-controlling valves FC which act on flows 12*a* and 12*b* and also on the flow 17. The flow 17 is normally divided up into several constituent flows which are added to the bottom of the digester at different heights.

The diffuser/diffusers 2*a*, 2*b* can also have one or more diffusers which are coupled in series, for example such that the pulp flow either passes by way of $\mathbf{2}a_1$-$\mathbf{2}a_2$-$\mathbf{2}a_3$ or, alternatively, by way of $\mathbf{2}b_1$-$\mathbf{2}b_2$-$\mathbf{2}b_3$, where the subscript $_1/_2/_3$ indicates the order in the direction of flow of the pulp. A first joint feed pump can then provide all the diffusers in at least one main feed line with pressurized washing liquid from a diffuser tank, which branch is in open communication with washing/dilution nozzles in the bottom of the digester, with the wash filtrate from each respective diffuser being returned to the main feed line. The pump $\mathbf{P2}_3$ which supplies the last diffuser is designed/selected such that the increase in pressure relative to the pressure in the main feed line exceeds the pressure fall in the diffuser and the prevailing pulp pressure at that position. When the diffusers are identical, a gradual increase in pressure in the direction $\mathbf{P2}_3 \rightarrow \mathbf{P2}_2 \rightarrow \mathbf{P2}_1$, on a par with 2 bar, should normally be implemented. In a typical example in which the first feed pump provides 4 bar, the pressure levels $\mathbf{P2}_3/\mathbf{P2}_2/\mathbf{P2}_1$ can be on a par with $_3/_5/_7$ bar if the prevailing pulp pressure in each respective diffuser (given by the pressure in the preceding digester) is on a par with $_4/_6/_8$ bar.

Sometimes, use is made of two or more parallel pumps which replace the pump P3, with each of the respective pumps supplying its own constituent flow to the bottom of the digester. Flow-controlling valves FC are also arranged in the Y coupling which regulates the flow of pulp to the parallel diffusers. Pressure-controlling outlet valves PC are also arranged in the outlets.

What is claimed is:

1. Method for supplying washing liquid to a digester (1) for cellulose pulp and a subsequent diffuser washing device (2*a*, 2*b*), with washing liquid for the diffuser wash being collected from a storage tank (4) and with washing liquid being conducted to the bottom of the digester for the purpose of obtaining a dilution and/or displacement wash at the bottom of the digester, characterized in that the washing liquid from the storage tank (4) is pressurized to a first pressure level via a first feed pump (P1) and conducted onwards to a main feed line (10), a first constituent flow (11) is drawn from the main feed line (10), at a first upstream point 10*a*) on the main feed line, to a diffuser pump device (P2*a*, P2*b*), which pressurizes the washing liquid to a second pressure level, and is conducted onwards (12*a*, 12*b*), at this second pressure level, to washing liquid inlets (14*a*, 14*b*) of a diffuser washing device, wash filtrate from a washing liquid outlet (15*a*, 15*b*) of the diffuser washing device (2*a*, 2*b*) is returned to the main feed line (10) at a second point (10*b*) on the main feed line, which point is located downstream of the first upstream point (10*a*) on the main feed line, a combined flow of washing liquid from the storage tank (4) and wash filtrate (16) from the diffuser washing device (2*a*, 2*b*) is conducted, via the main feed line (10), to a digester pump (P3) which pressurizes the combined flow to a third pressure level and conducts the combined flow (17) onwards, at this third pressure level, to washing liquid nozzles (18) which are arranged at the bottom of the digester.

2. Method according to claim 1, characterized in that the first pressure level is lower than the second pressure level, which second pressure level is in turn lower than the third pressure level.

3. Method according to claim 2, characterized in that each respective pressure level constitutes an increase in pressure of at least 50–125% as compared with the next lower pressure level.

4. Method according to claim 1, characterized in that the diffuser washing device (2*a*, 2*b*) consists of at least one pressure diffuser, which maintains a positive pressure in the pulp during the washing.

5. Method according to claim 1, characterized in that the diffuser washing device consists of two diffuser washing devices (2*a*, 2*b*), which are coupled in parallel with regard to the receipt and treatment of cooked pulp (20) obtained from the digester.

6. Method according to claim 5, characterized in that the diffuser pump device consists of two diffuser pumps (P2*a*, P2*b*) which are coupled in parallel and which are connected, on the inlet side, to the first constituent flow (11) taken from the main feed line (10), with the respective outlet from each of the diffuser pum devices only supplying one diffuser.

7. Method according to claim 6, characterized in that the wash filtrate (13*a*, 13*b*) which is obtained from each respective diffuser is firstly combined into a joint flow (16) in a Y coupling, after which this combined wash filtrate flow is returned to the main feed line (10) at the second point point (10*b*) on the main feed line which is closer to the inlet of the digester pump (P3).

8. Method according to claim 1, characterized in that the system for supplying the washing liquid to the digester and diffuser lacks any buffer or intermediate storage tanks after the first feed pump (P1) has pressurized the washing liquid.

* * * * *